US005429478A

United States Patent [19]

Krizan et al.

[11] Patent Number: 5,429,478

[45] Date of Patent: Jul. 4, 1995

[54] AIRFOIL HAVING A SEAL AND AN INTEGRAL HEAT SHIELD

[75] Inventors: Lawrence I. Krizan, Amston; John P. Sadauskas, Wallingford, both of Conn.

[73] Assignee: United Technologies Corporation, Hartford, Conn.

[21] Appl. No.: 220,621

[22] Filed: Mar. 31, 1994

[51] Int. Cl.[6] ..... F01D 11/00

[52] U.S. Cl. ..... 415/173.7; 415/174.4; 415/174.5; 415/115

[58] Field of Search ..... 415/173.7, 173.1, 173.4, 415/173.5, 174.4, 174.5, 115, 116; 277/53

[56] References Cited

U.S. PATENT DOCUMENTS

| | | | |
|---|---|---|---|
| 3,689,971 | 9/1972 | Davidson | 415/173.4 |
| 4,820,116 | 4/1989 | Hovan et al. | 415/115 |
| 5,217,348 | 6/1993 | Rup, Jr. et al. | 415/115 |
| 5,252,026 | 10/1993 | Shepherd | 415/115 |

*Primary Examiner*—Edward K. Look
*Assistant Examiner*—Christopher Verdier

[57] ABSTRACT

An airfoil for a gas turbine engine includes a platform having an integral heat shield extending over a seal. Various construction details are developed that disclose a heat shield that protects the seal structure from damage due to exposure to hot gases within the gas turbine engine. In a particular embodiment, a turbine vane includes a platform having a heat shield extending from the leading edge of the platform and a recess. The heat shield extends over the outward surface of a honeycomb seal that is disposed within the recess.

5 Claims, 2 Drawing Sheets

AIRFOIL HAVING A SEAL AND AN INTEGRAL HEAT SHIELD

TECHNICAL FIELD

This invention relates to gas turbine engines, and more particularly to airfoils for such engines.

BACKGROUND OF THE INVENTION

A typical gas turbine engine has a flow path extending about a longitudinal axis and includes a compressor, combustor and turbine spaced sequentially along the flow path. Both the compressor and turbine include adjacent arrays of airfoils that engage fluid flowing through the flow path. The arrays are made up of rotating blades and stationary vanes. The rotating blades either transfer energy to the fluid, as in the compressor, or remove energy from the fluid, as in the turbine. Each array of vanes is located upstream of an array of blades and is configured to orient the flow of fluid for optimal engagement with the downstream blade.

In addition to the vanes, inner and outer surfaces are used to confine the flow of fluid within the annular flow path through the gas turbine engine. For the vanes, the flow surfaces are provided by platforms that are integral to the inner and outer ends of the vane. For the blades, the inner surface is provided by a platform that is integral to the blade and the outer surface is provided by a shroud having a circumferential flow surface radially outward of the tips of the blades.

The blade arrays and vane arrays are axially spaced a finite distance as a result of having adjacent rotating blade arrays and non-rotating arrays. Therefore, some form of sealing mechanism is required to discourage fluid from flowing radially inward between the adjacent arrays. In addition to the loss of efficiency because of fluid escaping around the arrays of blades, gas turbine engine components located radially inward of the flow path may be damaged by contact with the hot gases from the flow path. Such components include rotor disks, which are under significant stress. As is well known, increasing the operating temperature of the rotor disk decreases the allowable stress of the disk material.

One popular form of sealing mechanism is a knife edge element engaged with a honeycomb type structure. Typically, the knife edge is extended from the rotating component and the honeycomb material is attached to the non-rotating component. The honeycomb material is formed from very thin (on the order of 0.004 in) sheet metal in the shape of open cells. During operation, the knife edge may engage the honeycomb material and wear a groove into the honeycomb material. The wearing of the honeycomb accounts for tolerances between the components and for thermal growth during operation. This type of sealing arrangement is desirable because the honeycomb material is inexpensive and is generally easily replaced once it wears away.

A drawback to using honeycomb material in a sealing mechanism is that it quickly degrades if exposed to the high temperatures present in the fluid flowing through the flow path. Degradation due to heat exposure causes the honeycomb seal to be replaced prematurely, i.e. prior to wearing out due to engagement with the knife edge. To account for this, honeycomb seals used in hot sections of the gas turbine engine are coated with a thermal barrier coating (TBC). The TBC protects the outward facing surfaces of the honeycomb. Unfortunately, the TBC applied to the honeycomb is often different from the TBC applied to the airfoil because the sheet metal of the honeycomb cannot withstand the high temperatures associated with the processes required to apply the common TBC used on airfoils. The added expense of a unique TBC and the expense of an additional step to apply the TBC increases the cost of fabricating the airfoil. Further, since the honeycomb seals are frequently replaced during the life of the airfoil, the costs associated with repairing and maintaining the airfoil may be excessive.

The above art notwithstanding, scientists and engineers under the direction of Applicants' Assignee are working to develop turbine components, such as airfoils, that have longer operational life expectancies and that are inexpensive to maintain.

SUMMARY OF THE INVENTION

According to the present invention, an airfoil includes a seal and a platform having an integral heat shield extending over the outward surface of the seal. The heat shield extends down from the edge of the platform and laterally over the seal. The seal is positioned on a seal land located on the underside of the platform and adjacent to the heat shield.

The heat shield blocks contact between the outward surface of the seal and the hot gases that flow into a cavity between the airfoil and an adjacent airfoil assembly. Contact with the hot gases may degrade the seal and require repair or replacement of the airfoil prematurely. The heat shield separates the seal from the hot gases to prevent such contact from occurring. In addition, the use of an integral heat shield eliminates the need to provide a thermal barrier coating over the outward facing surface of the seal.

In another particular embodiment, the heat shield extends outward from the flow surface side of the platform such that, during operation, the heat shield is proximate to the trailing edge of the adjacent airfoil assembly. The proximity between the heat shield and the airfoil assembly defines a choke point to discourage flow between the two points. The combination of the choke point and the seal engagement defines an outer cavity therebetween. The choke point reduces the amount of hot gases flowing into the outer cavity and thereby minimizes the temperature of the gases within the outer cavity. In addition, an inner cavity, disposed on the opposite side of the seal, is pressurized with cooling fluid to further discourage hot gases from flowing through the seal. This results in a cooler inner cavity, relative to the outer cavity, adjacent to the rotor disk and rotating seals.

The foregoing and other objects, features and advantages of the present invention become more apparent in light of the following detailed description of the exemplary embodiments thereof, as illustrated in the accompanying drawings.

DESCRIPTION OF THE PREFERRED EMBODIMENT

Figure 1:
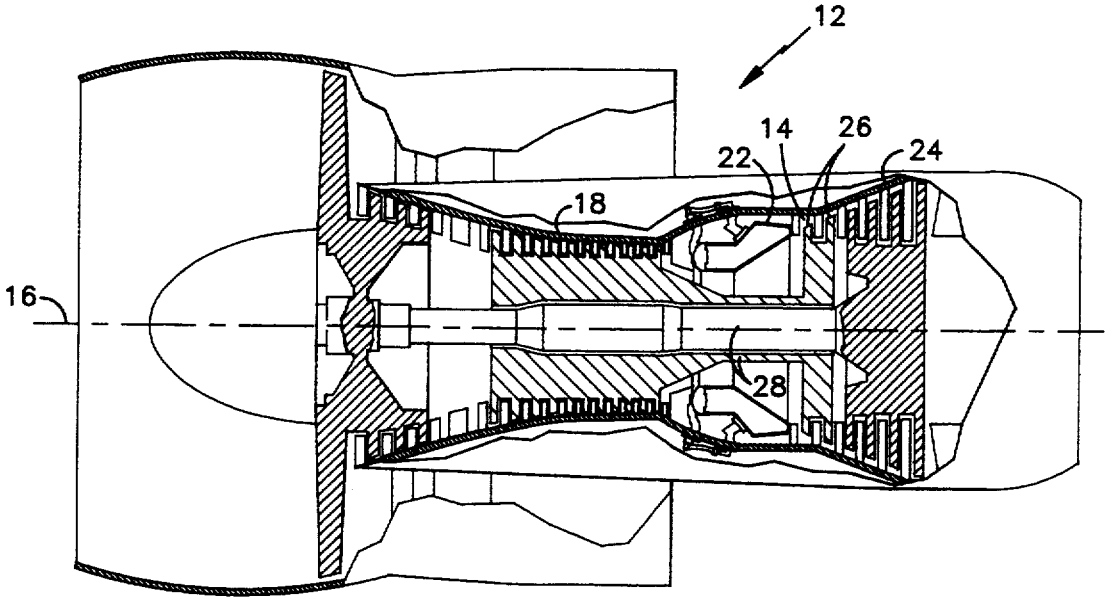
FIG. 1 is a cross-sectional side view of a gas turbine engine.

A gas turbine engine 12 is illustrated in FIG. 1. The gas turbine engine 12 includes an annular flow path 14 disposed about a longitudinal axis 16. A compressor 18, combustor 22 and turbine 24 are spaced along the axis with the flow path 14 extending sequentially through each of them. The turbine 24 includes a plurality of rotor assemblies 26 that engage working fluid flowing through the flow path 14 to transfer energy from the flowing working fluid to the rotor assemblies 26. A portion of this energy is transferred back to the compressor 18, via a pair of rotating shafts 28 interconnecting the turbine 24 and compressor 18, to provide energy to compress working fluid entering the compressor 18.

Figure 2:
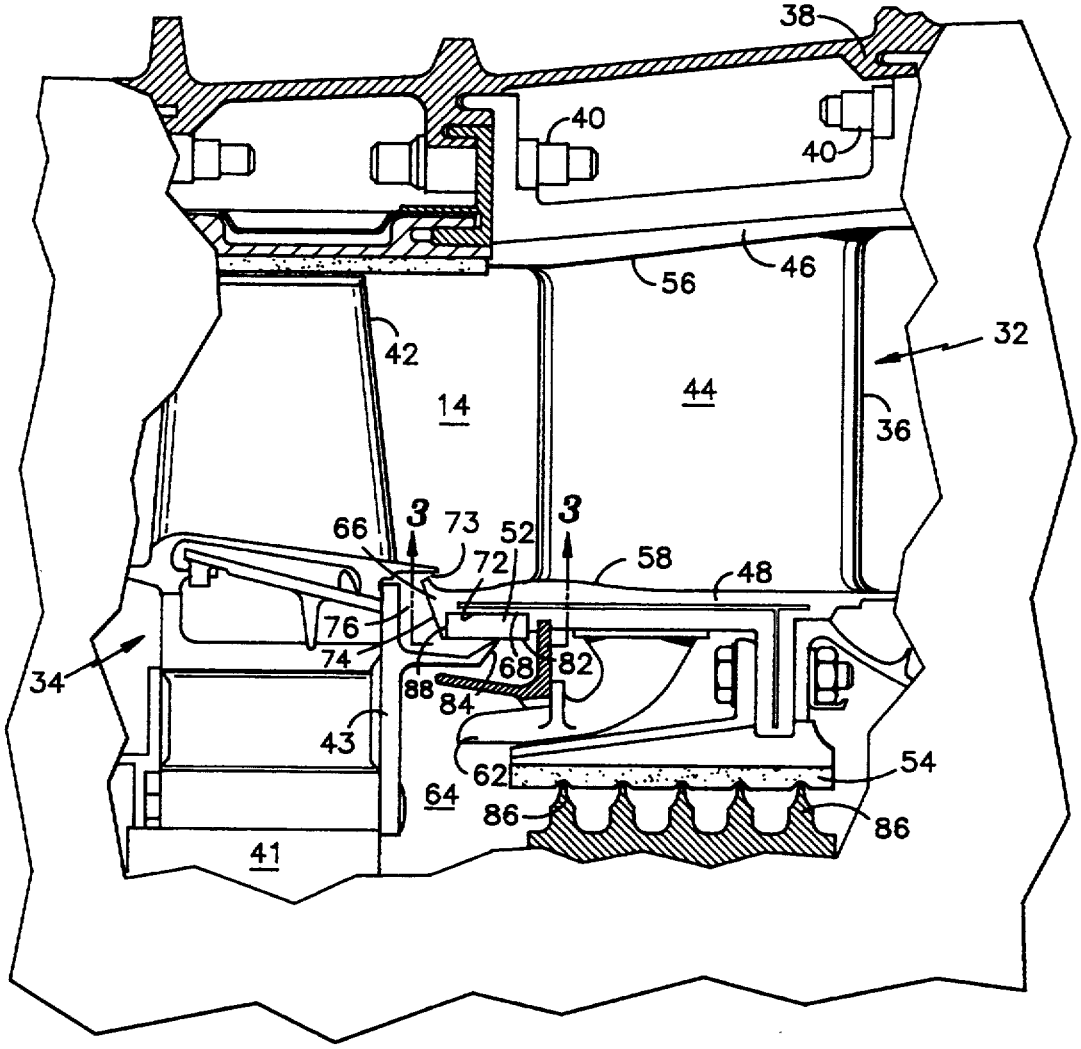
FIG. 2 is a side view of a turbine vane assembly and an adjacent turbine rotor assembly and turbine shroud.

Referring now to FIG. 2, a turbine vane assembly 32 and an adjacent, upstream turbine rotor assembly 34 is illustrated. The turbine vane assembly includes a plurality of circumferentially spaced vanes 36 attached to the stator structure 38 by a fastener means 40. The turbine rotor assembly 34 includes a rotating disk 41, a plurality of circumferentially spaced blades 42 and a sideplate 43.

Each of the vanes 36 includes an aerodynamic portion 44, an outer platform 46, an inner platform 48, a platform seal 52, and a second seal 54. The aerodynamic portion 44 extends through the flow path 14. The outer platform 46 and the inner platform 48 define radially outer and radially inner flow surfaces 56,58 for the flow path 14. Extending radially inward from the inner platform 48 is a cooling fluid ejector 62. The cooling fluid ejector 62 is in fluid communication with the hollow core of the vane 36 and directs cooling fluid into an inner cavity 64 between the vane assembly 32 and the rotor assembly 34.

The inner platform 48 defines the radially inner flow surface 58 and includes a heat shield 66 and a laterally extending recess 68 defining a seal land 72. The heat shield 66 is positioned along the leading edge of the inner platform 48 and extends radially inward over the platform seal 52. The heat shield also extends radially outward towards the trailing edge of the blades 42 to define a choke point 73 between the vane assembly 32 and the rotor assembly 34. The heat shield 66 has a surface 74 facing away from the vane 36 and into an outer cavity 76 between the rotor assembly 34 and the vane assembly 32.

Figure 3:
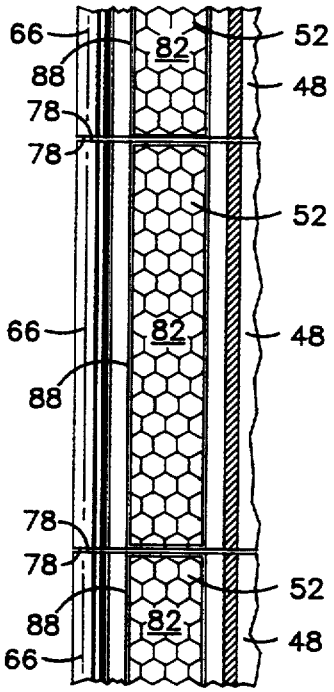
FIG. 3 is a view of adjacent turbine vanes taken along line 3—3 of FIG. 2.

The platform seal 52 is a laterally and axially extending sheet of honeycomb foil material attached to the seal land 72. The platform seal 52 extends the width of the inner platform 48 such that the lateral surfaces 78 of platform seals 52 of adjacent vanes 36 are proximate to each other, as shown in FIG. 3. The plurality of platform seals 52 define a sealing surface 82 that is proximate to and, under some operating conditions of the gas turbine engine, engaged with a knife edge 84 projecting from the rotor sideplate 43. The recess 68 axially locates the platform seal 52 into the proper position for engagement with the knife edge 84. The knife edge 84 is circumferentially continuous such that, in conjunction with the plurality of platform seals 52, fluid is blocked from flowing between the knife edge 84 and platform seal 52.

The second seal 54 is disposed radially inward of the vane 36 and is proximate to a plurality of knife edge seals 86 that extend between the rotor assembly 34 and another rotor assembly located downstream of the vane assembly 36 (not shown). The second seal 54 and the plurality of knife edges 86 combine to block fluid from flowing around and bypassing the aerodynamic portion 44 of the vane 36.

During operation, hot gases flow through the flow path 14, performing work upon the rotor assembly 34, and then flowing over the aerodynamic portions 44 of the vane assembly 32 to be oriented for engagement with the downstream rotor assemblies. A portion of this hot working fluid will flow inward through the choke point 73 and into the outer cavity 76. The choke point 73 will discourage fluid from flowing in this direction but may not eliminate it from occurring. Within the outer cavity 76, the fluid is blocked from flowing through the seal defined by the engagement of the platform seal 52 and the knife edge 84. As a result, a recirculation zone is created within the outer cavity 76 that mixes the fluid within the outer cavity 76 with hot gases flowing through the choke point 73.

Cooling fluid flows through the vane 36 and is ejected into the inner cavity 64 by the fluid ejector 62. This ejected fluid is directed radially inward to flow over the disk 41 and the plurality of seals 86. In addition, the ejected cooling fluid pressurizes the inner cavity 64 such that fluid is discouraged from flowing from the outer cavity 76, through the platform seal 52 and into the inner cavity 64. The combination of the platform seal 52 and the pressurized inner cavity 64 maintain the inner cavity 64 at a lower temperature than the outer cavity 76 to maintain the rotating components, such as the disk 41 and plurality of seals 86, within an acceptable temperature range.

Within the outer cavity 76, the heat shield 66 protects the outward facing surface 88 of the platform seal 52 from engagement with the hot gases flowing into the outer cavity 76 from the flowpath 14. As a result, the thin sheet metal of the outward facing surface 88 is protected from rapidly deteriorating due to heat damage. The function of the heat shield 66 is to prevent hot gases from flowing directly onto the outward facing surface 88. Therefore, the heat shield may extend over the entire outward facing surface or may only be necessary over the portion of outward facing surface that is at risk of direct engagement with hot gases flowing into the cavity. The seal surface 82, though directly exposed, is less susceptible to heat damage because the hot gases that flow into the outer cavity 76 mix with the fluid circulating within the outer cavity 76. The mixing reduces the temperature of the fluid that engages the seal surface 82. Therefore, less protection is required for this surface 82. In addition, the lateral sides 78 of the individual platform seals 52 may also be exposed to the hot gases. The close proximity of the adjacent sides 78, however, limits the amount of fluid that may flow between the adjacent platform seals 78.

The vane 36 is typically formed by casting. The heat shield 66 as shown in FIGS. 2 and 3 is integral to the inner platform 48 and may be formed during the casting of the vane 36. If required, a thermal barrier coating may be applied to the external surfaces of the vane 36, including the heat shield 66. The presence of the heat shield 66 minimizes or eliminates the need to apply a thermal barrier coating to the seal 52.

Although the embodiment disclosed in FIGS. 2 and 3 is a turbine vane having a heat shield and recess for a seal, it should be noted that the invention may be applied to other types of airfoils, including turbine blades and compressor blades and vanes.

Although the invention has been shown and described with respect with exemplary embodiments thereof, it should be understood by those skilled in the art that various changes, omissions, and additions may be made thereto, without departing from the spirit and scope of the invention.

What is claimed is:

1. An airfoil for a gas turbine engine, the gas turbine engine including a flow path disposed about a longitudinal axis and further including a plurality of axially adjacent airfoil assemblies, the airfoil including an aerodynamic portion, a platform, and a seal, the aerodynamic portion extending through the flow path in an installed condition, the platform having a flow surface facing the flow path in the installed condition, a seal land, and an integral heat shield, the seal land extending along the platform and providing a surface for attachment of the seal, the seal being located to be proximate to an extension of an axially adjacent airfoil assembly in the installed condition, such proximity blocking fluid flow between the seal and the extension, the seal including a surface facing outward in a direction away from the aerodynamic portion, the heat shield extending from the platform and at least partially extending over the outward facing surface of the seal, and wherein in the installed condition the heat shield blocks contact between fluid from the flow path and the outward facing surface of the seal.

2. The airfoil according to claim 1, wherein the airfoil is a turbine vane, and wherein the adjacent airfoil assembly is a rotor assembly having the extension disposed thereon.

3. The airfoil according to claim 1, wherein the seal is a honeycomb seal of the type having the outward facing surface formed from a foil material.

4. The airfoil according to claim 1, further including a projection extending into the direction of the adjacent airfoil assembly, such that during operation of the gas turbine engine the projection is proximate an edge of the adjacent airfoil assembly to produce a choke point, the choke point discouraging fluid flow between the adjacent airfoil assembly and the airfoil, wherein a cavity is defined by an axial separation of the airfoil and the adjacent airfoil assembly and a radial separation of the choke point and adjacent portions of the extension and seal land, the heat shield blocking contact between fluid within the cavity and the outward facing surface of the seal.

5. The airfoil according to claim 1, wherein the seal is a honeycomb seal of the type having the outward facing surface formed from a foil material, wherein the airfoil is a turbine vane, and wherein the adjacent airfoil assembly is a rotor assembly having the extension disposed thereon, such that during operation of the gas turbine engine a recirculation zone for fluid is generated in the cavity, and wherein during operation of the gas turbine engine the heat shield blocks continuous contact between the foil material of the outward facing surface and the fluid within the recirculation zone.

* * * * *